United States Patent [19]

Hoie

[11] 4,383,564

[45] May 17, 1983

[54] COLLAPSIBLE, PORTABLE, OPEN-TOP CONTAINER FOR LIQUID, PREFERABLY

[76] Inventor: Karl H. Hoie, Heming Vei 4, Oslo 3, Norway

[21] Appl. No.: 211,795

[22] Filed: Dec. 1, 1980

[51] Int. Cl.[3] ..... B65D 33/38; B65D 30/28

[52] U.S. Cl. ..... 150/0.5; 150/9; 150/52 R

[58] Field of Search ..... 150/0.5, 1, 9, 52 R

[56] References Cited

U.S. PATENT DOCUMENTS

| | | | |
|---|---|---|---|
| 983,492 | 2/1911 | Harriss | 150/52 R |
| 1,289,410 | 12/1918 | Day | 150/9 X |
| 2,391,374 | 12/1945 | Wickstrum | 150/0.5 |
| 2,633,172 | 3/1953 | Treiber | 150/0.5 |
| 2,854,049 | 9/1958 | Wyllie | 150/1 |
| 3,095,206 | 6/1963 | Fresia et al. | 150/1 |
| 3,213,628 | 10/1965 | Serota | 150/0.5 X |
| 3,428,978 | 2/1969 | Johnson | 150/0.5 X |
| 3,727,656 | 4/1973 | Luders | 150/1 |
| 4,124,049 | 11/1978 | Yamaguchi | 150/0.5 |
| 4,136,725 | 1/1979 | Phillips et al. | 150/0.5 |

FOREIGN PATENT DOCUMENTS

| | | | |
|---|---|---|---|
| 711977 | 6/1965 | Canada | 150/1 |
| 1550509 | 8/1979 | United Kingdom | 150/1 |

*Primary Examiner*—Willaim Price
*Assistant Examiner*—Sue A. Weaver
*Attorney, Agent, or Firm*—Browdy and Neimark

[57] ABSTRACT

A portable folding water tank which is reversible and can present one of two colors for military camouflage purposes. The tank has a shape of a truncated cone and includes filler pipe means at the bottom. A cover which can also serve as a carrier for the folded tank is also provided.

11 Claims, 6 Drawing Figures

COLLAPSIBLE, PORTABLE, OPEN-TOP CONTAINER FOR LIQUID, PREFERABLY

A collapsible, portable, open-top container for liquids, preferably water, having a bottom and side walls made of a flexible, high-tensile-strength material, and a ring-shaped float body disposed along the upper edge portion of the side walls, said float body in its entirety being disposed inwardly of the circumference of said bottom. When the container is filled with water it rises to its full height and the side walls converge strongly toward the top such that the container assumes the shape of a truncated cone and thereby becoming quite stable with respect to loading on the upper edge of the walls and in regard to the nature of the foundation on which it rests. The invention container can be placed on an uneven or even or sloping foundation and makes a very practical water reservoir for various purposes.

The present invention relates to a collapsible, portable, open-top container for liquid, preferably water, of the type defined in the preamble of the appurtenant main claim.

The known containers of the above type are primarily utilized as swimming or wading pools for children and are therefore provided with vertical or slightly inwardly-sloping walls with a float body disposed at the inner, upper edge of the wall, such that one obtains a free water surface approximately as large as the pool's ground surface.

A pool of this type has to rest on an approximately horizontal and level foundation so that the ring-shaped float body at the upper edge of the side walls will lie interiorly of the perimeter of the pool bottom and will thus float on the water and hold the side walls of the pool upright. Such a pool cannot withstand very much loading at the upper edge of the side walls, as too much pressure will cause the wall to collapse and allow the water to spill over the edge.

The object of the present invention is to provide a container of the above-defined type which is substantially less critical with respect to loading on the upper edge of the walls and in regard to the nature of the foundation on which it rests.

This is obtained according to the invention in that the container is formed with a top opening whose diameter is substantially smaller than the diameter of the bottom, the side walls converging strongly upwardly from the bottom periphery to the periphery of the opening, such that the container assumes the shape of a truncated cone if the bottom and opening are circular in shape, which is the most practical embodiment.

A collapsible and portable container of this type, which can be placed on an uneven or even or sloping foundation and which rises to its full height when filled with water, makes a very practical water reservoir in connection with a unit for producing hot water and optionally steam for various purposes, for example, for relief operations in connection with natural disasters or for military operations. The container should therefore be provided with at least one sealable pipe connection at the lower edge portion of the side wall for tapping/filling the reservoir. By providing said pipe connections with threads, filling and tapping hoses can easily be connected to the container. One must be able to seal off the pipe connections, and for this purpose screw caps or screw plugs can be provided which cooperate with respective external or internal threads in the pipe. In addition, the pipe connections should be provided with a check valve to prevent water from flowing out when the closure means is removed, this value consisting, for example, of a movable flap secured inside the container at the upper edge of the opening for the pipe connection in the container wall, with a cord attached to the flap and passing up over the upper edge of the container and down the outside of the container to the removable closure means for the pipe connection. The check valve can be opened by pulling the cord after the closure means has been removed from the end of the pipe connection to permit water to be tapped from the container.

Since the container may be used during military operations, as mentioned above, the color of its exterior surface ought to blend in with the surroundings. The container is therefore made of a relatively dark-colored material on one side, e.g., olive green, and a light-colored material on the other side, preferably white. As the container material is flexible, the container can easily be turned inside our so that one obtains the desired color on the exterior for summer or winter conditions.

Since the container is reversible for camouflage purposes, it must be provided with two sets of pipe connections with check valves which work in opposite directions, so that filling and tapping hoses can be connected to outwardly-projecting pipe connections no matter which side of the container is facing out.

For camouflage purposes, the container may be made of a material which does not reflect infrared rays, so that a container which is relatively large can not be discovered by means of binoculars or instruments which register infrared rays.

In some instances, it may be desirable to transport the container, filled with water, on a truck, and it is then important to ensure that the upper edge of the container cannot move back and forth with changes in acceleration/deceleration or move to the sides when rounding curves, as the edge of the opening would become lowered during such movement and the water would spill out.

To prevent such movement of the upper portion of the container, outwardly-projecting loops are attached to the upper edge of the container, four such loops, for example, being provided for attachment to guy ropes which can then be secured to the longitudinal sides of the truck bed and to its forward and rear edges.

To close the opening of the container, a cover made preferably of the same material as the container is provided, being circular in shape and having a plurality of openings around its periphery through which a drawstring is threaded, such that the edges of the cover can be folded in beneath the lower edge of the ring-shaped float body at the opening of the container. The cover thus has a diameter which is somewhat larger than the diameter of the opening. The cover can also be used as a casing for the collapsed and folded container, the container being placed as a compact package on the cover and the outer edges of the cover being drawn up around the package by means of said drawstring.

The characteristic features of the invention are recited in the appurtenant patent claims and will become further apparent in the following description of an embodiment of the invention, as illustrated on the accompanying drawings.

Figure 1:
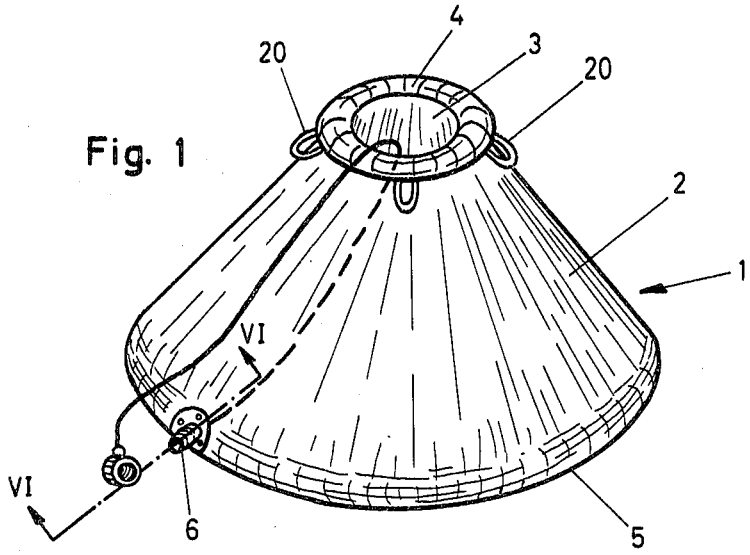
FIG. 1 shows the container in an upright, i.e., filled position.

FIG. 1 shows the container 1 with side walls 2 and an opening 3 at the top surrounded by a ring-shaped float body 4 secured to the upper edge of the wall 2. The bottom 5 of the container and the opening 3 are circular in shape, the ratio between the respective diameters of the top opening 3 and the bottom 5 being about 1:3. The height of the container is about 1.6 times the diameter of the opening 3, and the container is thus cone-shaped with the side walls 2 converging from the circumference of the bottom 5 to the circumference of the top opening 3.

The container 1 may, for example, have a bottom diameter of 3 m, an opening diameter of 1 m and a height of 1.60 m. The container is made of a water-tight, flexible material of high tensile strength which is preferably dark-colored on one side and light-colored on the other, preferably olive green and white, respectively. This is to enable the container to blend with its surrounding both summer and winter, as the container can be reversed to obtain the desired exterior color.

Figure 2:
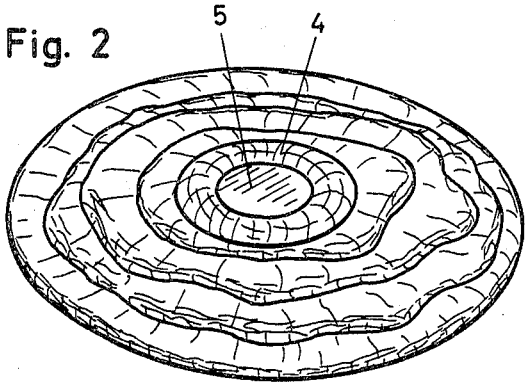
FIG. 2 shows the container collapsed and laid flat.
Figure 6:
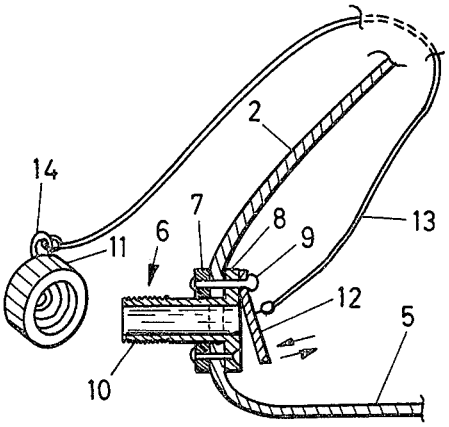
FIG. 6 is a cross section through the container along the line VI—VI of FIG. 1, showing in enlarged detail the tapping/filling pipe connection with the check valve and closure means.

When the container is being filled from the flat position shown in FIG. 2, the ring-shaped body 4 will float on the water collecting in the bottom 5 of the container and will draw the side walls 2 up as the water rises until the container assumes the position shown in FIG. 1, being then in the shape of a truncated cone. The container can be filled by means of a hose placed over the edge of the opening 3, or with a hose which is connected to a filling/tapping pipe connection 6, as shown in FIGS. 1 and 6. The pipe connection 6 is primarily intended for tapping water from the container; a hose is screwed onto the pipe connection 6, which is optionally provided with threads or other coupling means, and the hose is taken to the location where the water is needed.

The pipe connection 6 as shown in FIG. 6, is secured to the side wall 2 of the container 1 near the bottom 5 by means of annular flanges 7,8 which are interconnected by means of screws or bolts 9. As shown in FIG. 6, the flange 8 is attached to the interior end of the pipe 6 inside the container, the pipe passes out through an opening in the side wall 2, and the flange is then slipped onto the pipe and secured to the flange 8 by means of said pins or bolts 9. The pipe connection 6 is provided with threads 10 on the outer end thereof, and a screw cap 11 screwed on to seal the pipe. At the interior end of the pipe connection 6 and attached to the upper edge of the flange 8 is a flap 12, which is movable toward and away from the flange 8 but which will lie sealed against the interior end of the pipe 6 owing to water pressure against the flap. In order to open the flap 12 and thus to permit water to be withdrawn through the pipe 6 when the screw cap 11 has been removed, a cord 13 is attached to the flap 12, passing up over the upper edge of the container and down to the screw cap 11, where it is secured to an eye 14. By pulling the cord 13, the flap 12 can be pivoted away from the pipe end 6, permitting water to flow freely out through the pipe connection 6 and optionally into a hose connected to the pipe.

The container 1 is preferably provided with at least two pipe connections 6 for the connection of filling and tapping hoses, respectively. In addition, since the container is reversible for adaption of its color to the surroundings, the container must be provided with an additional set of pipe connections and check flaps projecting in the opposite direction from the first mentioned pipe connections. Screw caps 11 are also secured to the pipe connections projecting inwardly in the container to prevent an outflow of water through these past the flaps 12. The second pipe connection is shown in FIG. 1, the two are the same except that they connect to the container to permit flow in opposite directions.

Figure 4:
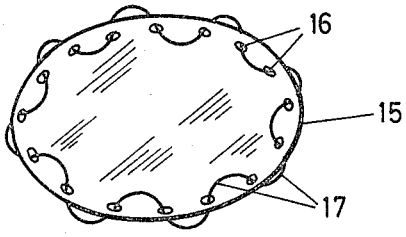
FIG. 4 shows the cover for the container.

To prevent dust and other material from entering the container through the top opening 3, a cover 15 as shown in FIG. 4 is provided, preferably made of the same material as the container 1. The cover is circular in shape and is provided with a plurality of holes 16 along its periphery through which a drawstring 17 is threaded. When the cover is placed over the opening 3 and float body 4, its outer edge region will close around and beneath the float body 4 when the drawstring 17 is tightened, such that the cover will remain firmly in place.

Alternately, the cover 15 can be provided with fastener means in the form of a VELCRO (registered Trade Mark) fastener, the two cooperating fastener members being disposed on the cover and on the upper portion of the container. The cover is secured by pressing the VELCRO members together, and removed by tearing the fastener members apart.

In still another alternative embodiment of the cover 15, belts having a number of holes can be secured to the periphery of the cover for engagement with buckles on the upper portion of the container, or vice-versa.

Figure 3:
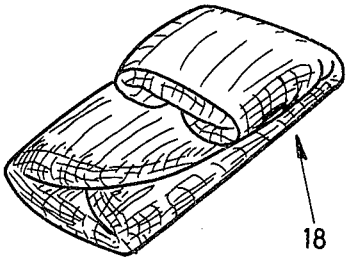
FIG. 3 shows the container partially folded.
Figure 5:
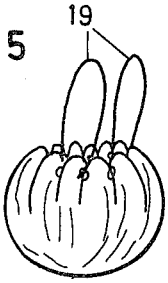
FIG. 5 shows the cover used as a casing for the folded container.

In FIG. 3, the container is shown partially folded into a compact package 18. The package 18 can be placed on the cover 15 and the edges of the cover drawn up around the package and brought together by tightening the drawstring 17, such that the cover then forms a casing for the collapsed container as shown in FIG. 5, where two loops 19, for example, are provided in addition to the drawstring 17 and can be used as handles for carrying the container.

The container 1 with the accessory equipment shown in FIGS. 4 and 6 is well suited for use as a water reservoir in connection with a unit for producing hot water and steam under various conditions, for example, for relief actions following a natural disaster or for military operations, and in particular in connection with the production of hot water and steam for field hospitals, and for washing and cleaning of equipment and personnel in ABC attacks.

One or several such containers 1 are placed at an appropriate location and hoses connected to pumps are coupled to the container's filling pipe connection 6 to fill the container with water, and a tapping hose is connected to a second pipe connection 6 to transport the water to a suitable heating unit, from which distribution hoses for the water and/or steam produced are led to the desired locations.

The advantage of using a container of the type described above rather than pumping water directly from a lake, river or stream is that the container can be filled even if the pumping capacity is limited, whereas the emergency water requirements for short periods may exceed the pumping capacity.

Several containers may also be connected either in series or in parallel, such that a water reservoir of the desired size may be provided.

The container 1 can also be transported on the bed of a truck in the filled state. It must then be provided with loops 20 at the upper edge thereof to which guy ropes can be attached. The guy ropes are then secured to the longitudinal sides of the truck bed and to its front and rear ends in order to prevent the upper portion of the container with the opening 3 from moving back and forth when accelerating/decelerating and from moving sideways when rounding curves, thus ensuring that the top edge of the opening remains stable so that the water cannot spill over the edge.

Having described my invention, I claim:

1. A collapsible, portable, open-top container for liquids, such as water, having a bottom and side walls made of a flexible, high-tensile-strength material, and a ring-shaped float body disposed along the upper edge portion of the side walls, said float body in its entirety being disposed inwardly of the circumference of said bottom, the container being such that when the container is filled, the side walls converge toward the top such that the ratio between the diameter of the opening and the diameter of the bottom is in the range of 1:2 to 1:5, preferably 1:3, and the ratio between the diameter of the opening and the height of the container is in the range of 1:1 to 1:8, preferably 1:1.6, at least two pipe connections are provided in a lower edge portion of said side walls, one projecting outwardly and one projecting inwardly, and said pipe connections having oppositely-operating check valves.

2. A collapsible, portable, open-top container for liquids, such as water, having a bottom and side walls made of a flexible, high-tensile-strength material, and a ring-shaped float body disposed along the upper edge portion of the side walls, said float body in its entirety being disposed inwardly of the circumference of said bottom, the container being such that when the container is filled, the side walls converge toward the top such that the ratio between the diameter of the opening and the diameter of the bottom is in the range of 1:2 to 1:5, preferably 1:3, and the ratio between the diameter of the opening and the height of the container is in the range of 1:1 to 1:8, preferably 1:1.6, a pipe connection in a lower edge portion of said side walls provided with a check valve to prevent outflow of water, and said check valve consists of a movable flap secured inside the container at the upper edge of the opening for the pipe connection in the container wall, there being attached to said flap a cord which is guided up over the upper edge of the container and down along the outside of the container to a removable closure member for the pipe connection.

3. A container according to claim 1 or 2, wherein the side walls are olive green on the outside and white on the inside.

4. A container according to claim 1 or 2, wherein at least the side walls consist of a non-infra-red reflecting material.

5. A container according to claim 1 or 2, wherein the bottom and opening of the container are circular such that the container in the filled state has the approximate shape of a truncated cone.

6. A container according to claim 1 or 2, said pipe connection(s) being provided with threads for engagement with corresponding threads on the closure member.

7. A container according to claim 1 or 2, wherein on the outside surface of the container, at the upper edge thereof, at least two loops are provided, disposed directly opposite one another, for the attachment of guy ropes.

8. A container according to claim 1 or 2, wherein the container can be closed by means of a cover consisting of a circular piece of material preferably having the same properties as the container material.

9. A container according to claim 8, characterized in that the piece of material has a diameter at least about 1.5 times larger than the diameter of the opening and has a plurality of holes around its periphery through which a drawstring is threaded for folding the periphery of the cover around the lower, bottom edge of the float body, and that the container can be encased in the cover, the cover surrounding the folded container when the drawstring is tightened.

10. A container according to claim 1 or 2, wherein a transition between the bottom and the side walls is formed by a cylindrical section.

11. A container according to claim 1 or 2, wherein said container is adapted for use with a mobile unit for producing hot water and/or steam for various purposes, for example, during relief operations in emergency situations caused by, for example, natural disasters, or for military operations.

* * * * *